US011225838B2

(12) United States Patent
Trunk

(10) Patent No.: US 11,225,838 B2
(45) Date of Patent: Jan. 18, 2022

(54) UNDERREAMER CUTTER BLOCK

(71) Applicant: Schlumberger Technology Corporation, Sugar Land, TX (US)

(72) Inventor: Philip G. Trunk, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 26 days.

(21) Appl. No.: 16/072,517

(22) PCT Filed: Jan. 20, 2017

(86) PCT No.: PCT/US2017/014206

§ 371 (c)(1),
(2) Date: Jul. 25, 2018

(87) PCT Pub. No.: WO2017/132052

PCT Pub. Date: Aug. 3, 2017

(65) Prior Publication Data

US 2019/0055787 A1 Feb. 21, 2019

Related U.S. Application Data

(60) Provisional application No. 62/288,209, filed on Jan. 28, 2016.

(51) Int. Cl.

| | |
|---|---|
| ***E21B 10/32*** | (2006.01) |
| ***E21B 10/567*** | (2006.01) |
| ***E21B 7/28*** | (2006.01) |

(52) U.S. Cl.

CPC ..... *E21B 10/322* (2013.01); *E21B 7/28* (2013.01); *E21B 10/325* (2013.01); *E21B 10/5673* (2013.01); *E21B 10/5676* (2013.01)

(58) Field of Classification Search

CPC ..... E21B 10/322; E21B 7/28; E21B 10/325; E21B 10/5673; E21B 10/5676;

(Continued)

(56) References Cited

U.S. PATENT DOCUMENTS

| | | | |
|---|---|---|---|
| 6,732,817 B2 * | 5/2004 | Dewey | E21B 7/067 |
| 7,900,717 B2 | 3/2011 | Radford et al. | |

(Continued)

FOREIGN PATENT DOCUMENTS

| | | |
|---|---|---|
| CN | 2672275 Y | 1/2005 |
| CN | 201874466 U | 6/2011 |

(Continued)

OTHER PUBLICATIONS

International Preliminary Report on Patentability issued in International Patent Application No. PCT/US2017/014206 dated Jul. 31, 2018, 8 pages.

(Continued)

*Primary Examiner* — Yong-Suk (Philip) Ro

(57) ABSTRACT

A downhole cutting apparatus includes a cutter block. The cutter block includes a formation facing surface with cutting elements coupled thereto. The cutting elements are arranged such that at least one cutting element has a different exposure relative to the formation facing surface than at least one other cutting element. In some embodiments, a row of cutting elements may have a gradually changing exposure. The exposure may change such that cutting elements nearer the gauge of the cutter block have less exposure than cutting elements farther from the gauge of the cutter block. In additional embodiments, an underreamer may include multiple cutter blocks. The cutter blocks may each have a different configuration in a backreaming portion, gauge portion, underreaming portion, any part thereof, or in a combination of the foregoing.

13 Claims, 9 Drawing Sheets

(58) Field of Classification Search
CPC ..... E21B 7/067; E21B 17/10; E21B 10/32; E21B 17/00; E21B 10/26; E21B 17/1014
See application file for complete search history.

(56) References Cited

U.S. PATENT DOCUMENTS

| | | | | |
|---|---|---|---|---|
| 7,997,354 | B2 | 8/2011 | Radford et al. | |
| 2003/0155155 | A1 | 8/2003 | Dewey et al. | |
| 2004/0154836 | A1 | 8/2004 | Hoffmaster et al. | |
| 2006/0207797 | A1 | 9/2006 | Dewey et al. | |
| 2010/0018779 | A1 | 1/2010 | Makkar et al. | |
| 2010/0276201 | A1 | 11/2010 | Makkar et al. | |
| 2012/0012397 | A1 | 1/2012 | Hall et al. | |
| 2012/0073879 | A1* | 3/2012 | Makkar | E21B 10/32 175/406 |
| 2013/0146361 | A1* | 6/2013 | Makkar | E21B 10/32 175/57 |
| 2013/0256036 | A1 | 10/2013 | Lyons | |
| 2014/0262523 | A1 | 9/2014 | Davis | |
| 2015/0068813 | A1 | 3/2015 | Moreno et al. | |
| 2015/0144405 | A1 | 5/2015 | Salvo et al. | |
| 2015/0184463 | A1 | 7/2015 | Patel et al. | |
| 2015/0285004 | A1 | 10/2015 | Makkar et al. | |

FOREIGN PATENT DOCUMENTS

| | | | |
|---|---|---|---|
| CN | 202483447 | U | 10/2012 |
| CN | 202832221 | U | 3/2013 |
| CN | 103485723 | A | 1/2014 |
| CN | 103556950 | A | 2/2014 |
| CN | 103924929 | A | 7/2014 |
| CN | 203701981 | U | 7/2014 |
| CN | 104499944 | A | 4/2015 |
| CN | 104763344 | A | 7/2015 |
| GB | 2460096 | A | 11/2009 |
| WO | 2015035143 | A1 | 3/2015 |
| WO | WO2015167788 | A1 | 11/2015 |
| WO | WO2017132033 | A1 | 8/2017 |

OTHER PUBLICATIONS

International Preliminary Report on Patentability issued in International Patent Application No. PCT/US2017/014005 dated Jul. 31, 2018, 10 pages.

International Search Report and Written Opinion issued in International Patent Application No. PCT/US2017/014206 dated Apr. 27, 2017, 12 pages.

International Search Report and Written Opinion issued in International Patent Application No. PCT/US2017/014005 dated Apr. 27, 2017, 12 pages.

First Office Action issued in Chinese Patent Application No. 201780008910.6 dated Nov. 14, 2019, 13 pages with English Translation.

First Office Action issued in Chinese Patent Application No. 201780008757.7 dated Oct. 23, 2019, 15 pages with English Translation.

Office Action received in U.S. Appl. No. 16/072,524 dated Jul. 23, 2020, 9 pages.

Second Office Action issued in Chinese Patent Application No. 201780008910.6 dated Oct. 26, 2020, 9 pages with English Translation.

Third Office Action issued in Chinese Patent Application No. 201780008910.6 dated Mar. 5, 2021, 16 pages with English Translation.

Decision to Grant issued in Chinese Patent Application No. 201780008910.6 dated Jul. 6, 2021, 8 pages with partial English Translation.

* cited by examiner

UNDERREAMER CUTTER BLOCK

CROSS-REFERENCE TO RELATED APPLICATIONS

This application claims the benefit of, and priority to, U.S. Patent Application No. 62/288,209 filed Jan. 28, 2016, which application is expressly incorporated herein by this reference in its entirety.

BACKGROUND

In the drilling of oil and gas wells, concentric casing strings are installed and cemented in the wellbore as drilling progresses to increasing depths. Each new casing string may run from the surface or may include a liner suspended from a previously installed casing string. The new casing string may be within the previously installed casing string, thereby limiting the annular area available for the cementing operation. Further, as successively smaller diameter casing strings are used, the flow area for the production of oil and gas is reduced. To increase the annular space for the cementing operation, and to increase the production flow area, it may be desirable to enlarge the wellbore below the terminal end of the previously cased portion of the wellbore. By enlarging the wellbore, a larger annular area is provided for subsequently installing and cementing a larger casing string than would have been possible otherwise. Accordingly, by enlarging the wellbore below the previously cased portion of the wellbore, comparatively larger diameter casing may be used at increased depths, thereby providing more flow area for the production of oil and gas.

Various methods have been devised for passing a drilling assembly through an existing cased portion of a wellbore and enlarging the wellbore below the casing. One such method is the use of an underreamer, which has basically two operative states. A first state is a closed, retracted, or collapsed state, where the diameter of the tool is sufficiently small to allow the tool to pass through the existing cased portion of the wellbore. The second state is an open, active, or expanded state, where arms or cutter blocks extend from the body of the tool. In this second state, the underreamer enlarges the wellbore diameter as the tool is rotated and lowered and moved axially in the wellbore.

SUMMARY

In some embodiments, a cutting apparatus includes a cutter block and cutting elements coupled to the cutter block. The cutting elements may include a cutting element having a different exposure relative to a formation facing surface of the cutter block than another cutting element. In some embodiments, the exposure may gradually change between cutting elements, which is optionally in an axial direction along the cutter block.

In additional embodiments, a cutting apparatus includes a body and a cutter blocks coupled to the body. Each of the cutter blocks may have cutting elements coupled thereto, and at least two of the cutter blocks may be different.

Additional embodiments relate to a method for underreaming, and include tripping an underreamer into a wellbore while the underreamer is in a retracted position. A plurality of cutter blocks of the underreamer may be expanded to transition the underreamer into an expanded position. Expanding the plurality of cutter blocks may include expanding a plurality of cutter blocks that have different configurations. The formation around the wellbore may be degraded by moving the underreamer axially and rotationally within the wellbore.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

FIGS. 2-1 and 2-2 are partial cut-away views of an underreamer, in accordance with embodiments disclosed herein.

FIG. 3-1 is a perspective view of a cutter block, in accordance with embodiments disclosed herein.

FIG. 3-2 is a side view of the cutter block of FIG. 3-1.

FIG. 3-3 is a top view of the cutter block of FIG. 3-1.

FIGS. 6-1 to 6-3 are cross-sectional views of cutter blocks, in accordance with embodiments disclosed herein.

FIGS. 10-1 is a perspective view of a ridge cutting element, in accordance with embodiments disclosed herein.

FIG. 10-2 is a side view of the ridge cutting element of FIG. 10-1.

FIGS. 12-1 to 12-3 are side views of cutting elements at varying back rake angles, in accordance with embodiments disclosed herein.

FIGS. 14-1 to 15-3 are various views of cutting elements having varying side rake angles, in accordance with embodiments disclosed herein.

DETAILED DESCRIPTION

In some aspects, embodiments disclosed herein relate generally to cutting structures for use on drilling tool assemblies. More specifically, some embodiments disclosed herein relate to cutting structures for an underreamer or other tool used to enlarge a previously existing wellbore.

According to some aspects of the disclosure, there is provided a downhole cutting apparatus, such as an underreamer, which may include a cutter block. The cutter block may have an underreaming portion or edge and a backreaming portion or edge. In one or more embodiments, the downhole cutting apparatus may be an expandable tool and the cutter block may be radially movable between any combination of a retracted position, partially expanded positions, and a fully expanded position. In one or more other embodiments, the downhole cutting apparatus may be a downhole cutting tool that is not expandable. For example, in one or more embodiments, the downhole cutting apparatus may be a hole opener having a fixed cutter block.

Figure 1:
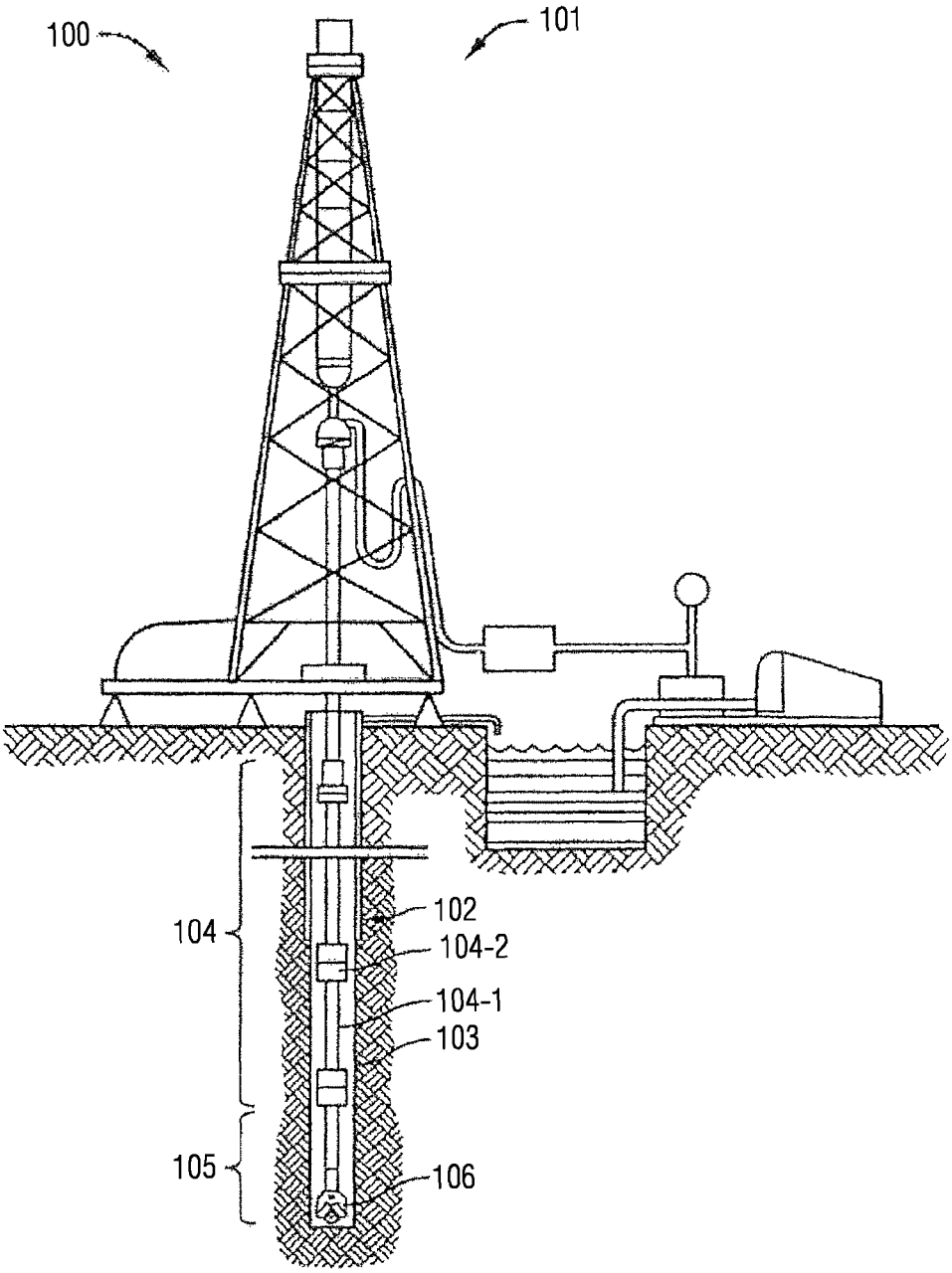
FIG. 1 is a schematic representation of a drilling operation.

Referring now to FIG. 1, one example of a system for drilling an earth formation is shown. The drilling system 100 includes a drilling rig 101 used to turn a drilling tool assembly 102 that extends into a wellbore 103. The drilling tool assembly 102 includes a drill string 104 and a bottom-hole assembly ("BHA") 105 attached to a distal or downhole end portion of the drill string 104. The distal end portion of the drill string 104 is the portion farthest from the drilling rig 101.

The drill string 104 includes several joints of drill pipe 104-1 connected end-to-end through tool joints 104-2. The drill string 104 may be used to insert or trip the BHA 105 into the wellbore 103. The drill string 104 may transmit drilling fluid (e.g., through a bore extending through hollow tubular members), transmit rotational power from the drilling rig 101 to the BHA 105, transmit weight to the BHA 105 (e.g., using weight of the drill string 104), move the BHA 105 axially within the wellbore, or combinations of the foregoing. In some embodiments, one or more of the drill string 104 or the BHA 105 further includes additional components such as subs, pup joints, valves, actuation assemblies, etc.

The BHA 105 in FIG. 1 includes a drill bit 106. A BHA 105 may also include additional components attached between the drill string 104 and the drill bit 106. Examples of additional BHA components include drill collars, stabilizers, measurement-while-drilling (MWD) tools, logging-while-drilling (LWD) tools, subs, hole enlargement devices (e.g., hole openers and reamers), jars, thrusters, downhole motors, sensors, and rotary steerable systems.

Figures 1, 2:
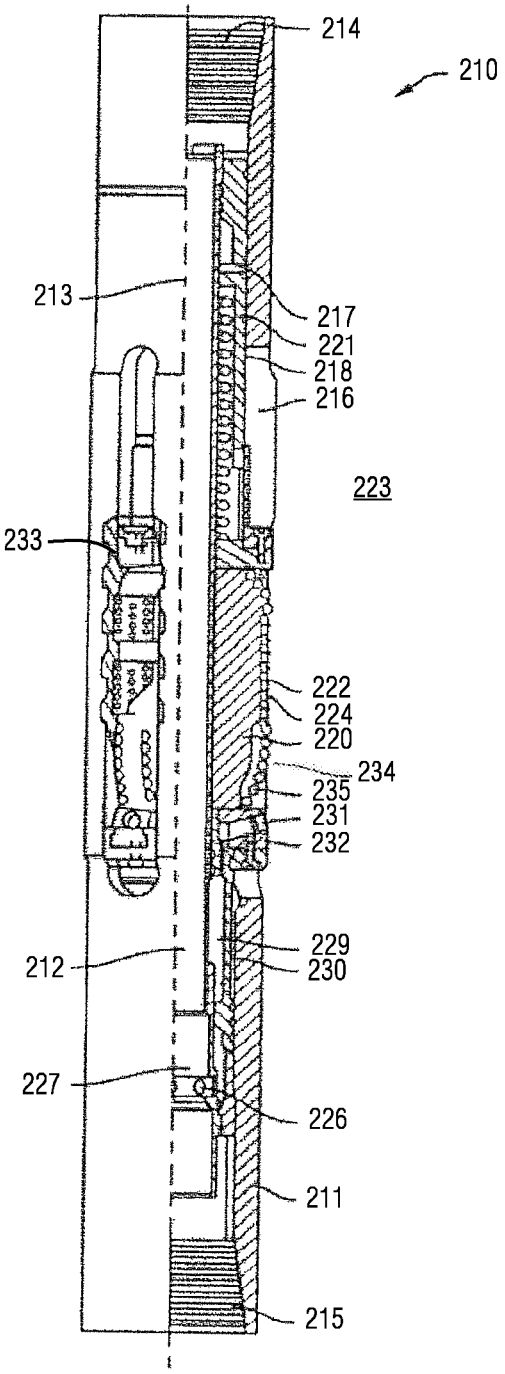
Figure 2:
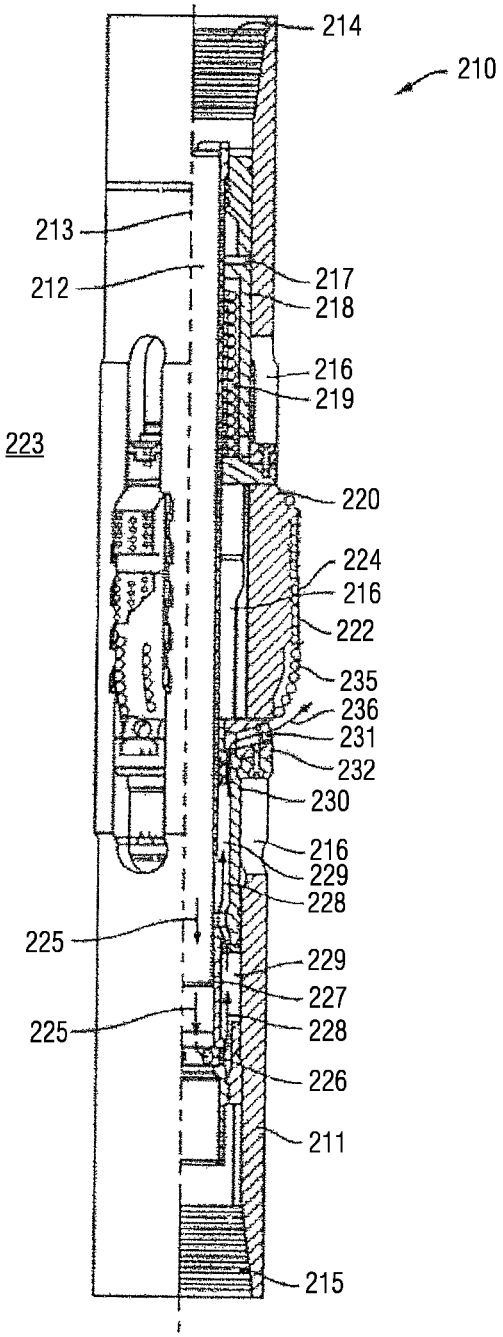

Referring to FIGS. 2-1 and 2-2, an expandable tool, which may be used in embodiments of the present disclosure, generally designated as underreamer 210, is shown in a collapsed position in FIG. 2-1 and in an expanded position in FIG. 2-2. The underreamer 210 may include a generally cylindrical tubular tool body 211 with a flowbore 212 extending fully or partially therethrough along a longitudinal axis 213 of the underreamer 210. As shown, the tool body 211 may include an upper connection portion 214 and a lower connection portion 215 for coupling the underreamer 210 to a drill string, BHA, or other downhole assembly. Further, as shown, one or more recesses 216 may be formed in the tool body 211, and optionally at approximately the axial center of the tool body 211. The one or more recesses 216 may be spaced apart azimuthally around the circumference of the tool body 211, and may be axially aligned or misaligned in various embodiments. The one or more recesses 216 may accommodate the axial movement of one or more components of the underreamer 210 that move axially within the tool body 211, and potentially within the recesses 216, including one or more moveable tool arms, such as cutter blocks 220. The cutter blocks 220 may be non-pivotable in some embodiments, but movable tool arms or cuter blocks may pivot in other embodiments. Each recess 216 may fully or partially store one or more cutter blocks 220 in the collapsed or retracted position.

FIG. 2-2 shows the underreamer 210 with the cutter blocks 220 in an expanded position (e.g., a maximum or fully expanded position), extending radially outwardly from the tool body 211. Once the underreamer 210 is in the wellbore, one or more of the cutter blocks 220 may be expandable to one or more radial positions. The underreamer 210 may therefore have at least two operational positions—including at least a collapsed or retracted position as shown in FIG. 2-1 and an expanded position as shown in FIG. 2-2. In other embodiments, the underreamer 210 may have multiple operational positions where the cutter blocks 220 are between fully retracted and fully expanded states (e.g., in partially expanded states). In some embodiments, a spring retainer 218, which may include a threaded sleeve, may be adjusted at the surface or using a downhole drive system, to limit the full diameter expansion of the cutter blocks 220. The spring retainer 218 may compress a biasing spring 219 when the underreamer 210 is collapsed, and the position of the spring retainer 218 may determine the amount of expansion of the cutter blocks 220. The spring retainer 218 may be adjusted by a wrench (not shown) in a wrench slot 217 that may rotate the spring retainer 218 axially downwardly or upwardly with respect to the tool body 211 at threads 221.

In the expanded position shown in FIG. 2-2, the cutter blocks 220 may be used to underream the wellbore, back-ream the wellbore, stabilizing a downhole or drilling assembly within the wellbore, or combinations of the foregoing. The operations performed may depend on the configuration of the cutter blocks 220, including one or more pads 222 and other surfaces. In some embodiments, the cutter blocks 220 may have configurations as further discussed herein. Hydraulic force within the underreamer 210 may cause the cutter blocks 220 to expand radially outwardly (and optionally to move axially upwardly) to the position shown in FIG. 2-2 due to the differential pressure of the drilling fluid between the flowbore 212 and the wellbore annulus 223.

In one or more embodiments, optional depth of cut limiters 224 on pad 222 may be formed from polycrystalline diamond, tungsten carbide, titanium carbide, cubic boron nitride, other superhard materials, or some combination of the foregoing. Depth of cut limiters 224 may include inserts with cutting capacity, such as back-up cutting elements or cutters, diamond impregnated inserts with less exposure than primary cutting elements, diamond enhanced inserts, tungsten carbide inserts, semi-round top inserts, or other inserts that may or may not have a designated cutting capacity. Optionally, the depth of cut limiters 224 may not primarily engage formation during reaming; however, after wear of primary cutting elements, depth of cut limiters 224 may engage the formation to protect the primary cutting elements from increased loads as a result of worn primary cutting elements. In one or more embodiments, depth of cut limiters 224 may be positioned above or uphole from primary cutting elements on a shoulder of the cutter block 220. The axial and/or radial distance from the primary cutting elements may be selected such that depth of cut limiters 224 may remain largely unengaged with formation until wear of other cutting elements occurs, or the depth of cut limiters 224 may engage the formation initially, before wear of the cutting elements. Depth of cut limiters 224 may aid in maintaining a desired wellbore gauge by providing increased structural integrity to the cutter block 220.

Drilling fluid may flow along path 225, through ports 226 in a lower retainer 227, along path 228 into a piston chamber 229. A differential pressure between fluid in the flowbore 212 and the fluid in the wellbore annulus 223 surrounding the underreamer 210 may cause the piston 230 to move axially upwardly from the position shown in FIG. 2-1 to the position shown in FIG. 2-2. A small amount of fluid can flow through the piston chamber 229 and through nozzles 231 to the wellbore annulus 223 as the cutter blocks 220 of the underreamer 210 expand. As the piston 230 moves axially upwardly in recesses 216, the piston 230 engages a drive ring 232, thereby causing the drive ring 232 to move axially upwardly against the cutter blocks 220. The drive ring 232 will move the cutter blocks 220 axially upwardly in recesses 216 and radially outwardly as the cutter blocks 220 travel in or along channels or splines 233 in or on the tool body 211. In the expanded position, the flow continues along paths 225, 228 and out into the wellbore annulus 223 through nozzles 231. The nozzles 231 may be part of the drive ring 232, and may therefore move axially with the cutter blocks 220. Accordingly, these nozzles 231 may be positioned to continuously provide cleaning and cooling to cutting elements 235 on surface(s) 234 as fluid exits to the wellbore annulus 223 along flow path 236. In other embodiments, the nozzles 231 may be omitted or may not travel with the cutter blocks 220.

The underreamer 210 may be designed to remain generally concentric within a wellbore. In particular, the underreamer 210, in some embodiments, may include three extendable cutter blocks 220 spaced apart circumferentially at the same axial location on the tool body 211. In some embodiments, the circumferential spacing may be approximately 120°. A three-block design may provide a full gauge underreamer 210 that remains centralized in the wellbore. Embodiments disclosed herein are not limited to tool embodiments having three extendable cutter blocks 220. For example, in one or more embodiments, the underreamer 210 may include different configurations of spaced cutter blocks (e.g., spaced axially, circumferentially, or both), or other types of arms, for example, one arm, two arms, four arms, five arms, or more than five arm designs. Thus, in some embodiments, the circumferential spacing of the cutter blocks or other arms may vary from the 120° spacing described herein. For example, in other embodiments, the circumferential spacing may be 90°, 60°, or the cutter blocks 220 may be circumferentially spaced in unequal increments. Further, in some embodiments, one or more of the cutter blocks 220 may be axially offset from one or more other cutter blocks 220. Accordingly, the cutting structure designs disclosed herein may be used with any number of cutting structures and tools.

Figures 1, 3:
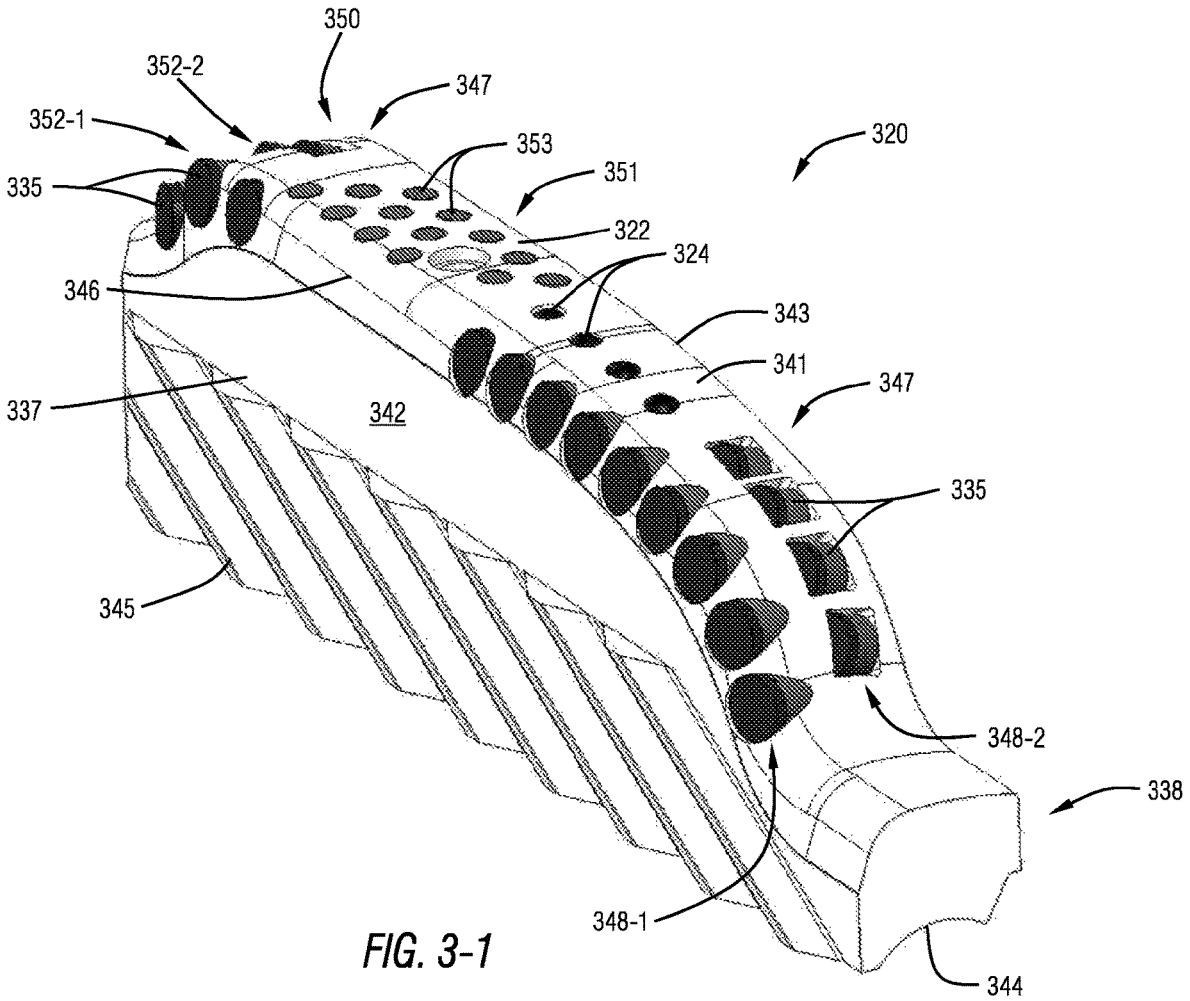
Figures 2, 3:
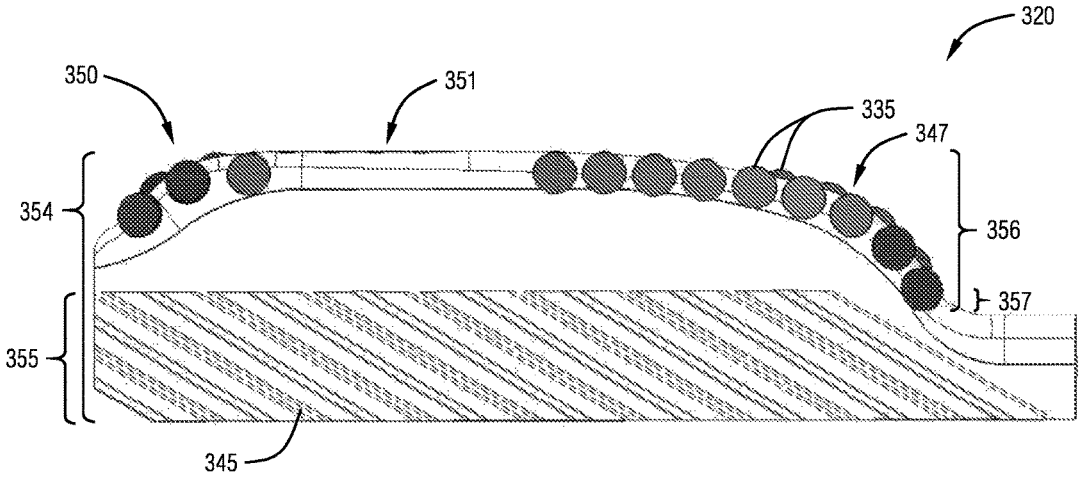
Figure 3:
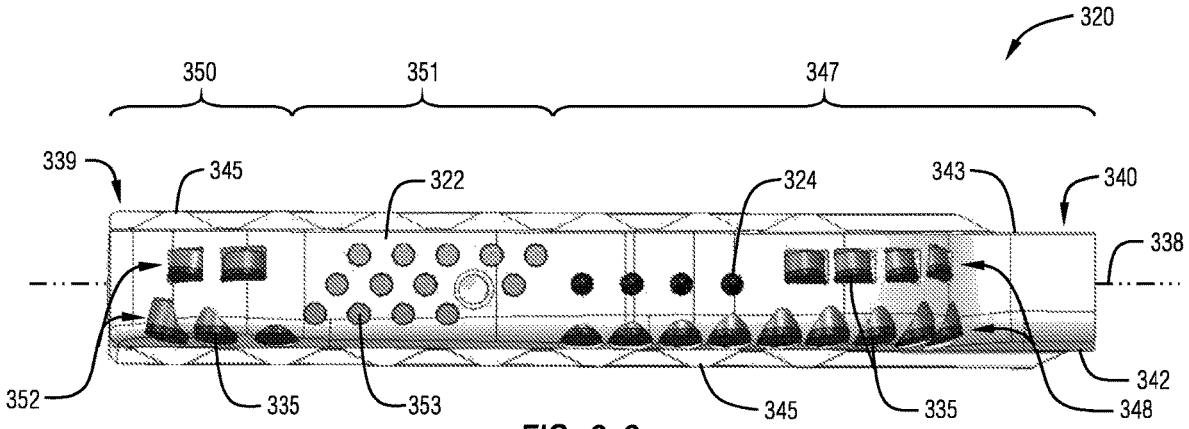

FIGS. 3-1 to 3-3 illustrate various views of a cutter bock 320 in accordance with embodiments described herein. As shown, the cutter block 320 may include a body 337 having a longitudinal axis 338. The cutter block 320 may further include a downhole end portion 339 and an uphole end portion 340. The body 337 of the cutter block 320 may further include or define a formation facing surface 341 arranged to abut, engage, or be positioned against or toward the formation within a wellbore. The cutter block 320 may be rotated in the wellbore, and the body 337 may define a leading side surface 342 facing the direction of rotation, and a trailing side surface 343 facing away from the direction of rotation. The formation facing surface 341 may generally extend laterally between the leading and trailing side surfaces 342, 343 and longitudinally in the direction of the longitudinal axis 338. A bottom surface 344 may also extend laterally between the leading and trailing side surfaces 342, 343 and longitudinally in the direction of the longitudinal axis 338, but may face away from the formation. In some embodiments, one or more splines or channels (collectively designated splines 345) may be formed on the leading side surface 342, the trailing side surface 343, or both, and used in selectively expanding or retracting the cutter block 320. For instance, the splines 345 may engage corresponding splines of a reamer body (e.g., splines 233 in FIG. 2-1), which may direct the cutter block 320 as it moves axially/longitudinally between radially expanded and radially retracted positions.

In one or more embodiments, the body 337 may be formed from a metal material, a matrix material, other materials, or a combination of the foregoing. For instance, the body 337 may be formed of or include steel, tungsten carbide, titanium carbide, or any other material known in the art. The cutter block 320 may be configured to be coupled to a downhole tool (e.g., the underreamer 230 shown in FIGS. 2-1 and 2-2). In one or more embodiments, the downhole end portion 339 of the cutter block 320 may be further downhole than the uphole end portion 340 of the cutter block 320 when the cutter block 320 is coupled to the downhole tool and within a wellbore. In one or more embodiments, the cutter block 320 may have a plurality of cutting elements 335 on, in, or otherwise coupled to the formation facing surface 341 of the body 337. In some embodiments, one or more cutting elements 335 may be on, in, or otherwise coupled to a leading edge 346 of the leading side surface 342 of the body 337. In one or more embodiments, the cutting elements 335 may be formed from tungsten carbide, polycrystalline diamond, cubic boron nitride, other materials, or any combination of the foregoing. In some embodiments, cutting elements, gauge protection elements, depth of cut limiters, or other components may be welded, brazed, bonded, adhered, press fit, or otherwise coupled to the body 337 (e.g., brazed within respective pockets formed in the body 337). In further examples, cutting elements, gauge protection elements, depth of cut limiters, or other components may be coupled to the body 337 by being integrally formed therewith, through infiltration techniques, or in other manners.

As shown, the cutting elements 335 coupled to the body 337 and within an underreaming portion 347 of the body 337 may be arranged in one or more rows 348-1, 348-2 (collectively rows 348). In this particular embodiment, for instance, and as shown in FIG. 3-1 and FIG. 3-3, the underreaming portion 347 is shown as including two rows 348 extending axially along a length of the cutter block 337. Such rows 348 are illustrated as having different lengths and numbers of cutting elements 335 (e.g., nine cutting elements 335 in leading row 348-1 at the leading side surface 342, and four cutting elements 335 in the trailing row 348-2 in the formation facing surface 341), although in other embodiments the rows 348 may have the same length or the same number of cutting elements. Optionally, the rows 348 may be about parallel to the longitudinal axis 338, parallel to each other, or both. In some embodiments, for example, there may be a substantially constant distance between cutting elements 335 in the leading row 348-1 and cutting elements 335 in the trailing row 348-2. This may be the case even if the rows 348 are curved, linear, angled, or otherwise arranged relative to the longitudinal axis 338. In other embodiments, the rows 348 may not be parallel or may have variable distances between leading and trailing cutting elements 335.

As also shown in FIG. 3-2, the cutting elements 335 in the rows 348 may be axially offset. In such an arrangement, the cutting elements 335 in the trailing row 348-2 may fully or partially fill gaps between cutting elements 335 in the leading row 348-1. The cutting elements 335 in the trailing row 348-2 may therefore be used to cut or remove materials that are left behind by the cutting elements 335 in the leading row 348-1. In other embodiments, one or more of the cutting elements 335 in the trailing row 348-2 may be at the same axial position as a cutting element 335 in the leading row 348-1, and may act as a depth of cut limiter or as a back-up cutter.

In some embodiments, one or more of the rows 348 may include elements in addition to, or other than, cutting elements 335. FIGS. 3-1 and 3-2, for instance, illustrate example depth of cut limiters 324 that extend partially along the length of the body 337, and which are generally aligned with the row 348-2. The depth of cut limiters 324 may be formed of any suitable material, including those used to form the cutting elements 335. The depth of cut limiters 324 may be arranged, designed, or otherwise configured to restrict or even prevent wear of the body 337 along the formation facing surface 341. For instance, as the cutter block 320 is used to cut or degrade formation in a wellbore, the formation may contact the depth of cut limiters 324, which may be raised relative to the formation facing surface. In some embodiments, the depth of cut limiters 324 may be raised above the surface to have about the same exposure as a corresponding leading cutting element 324; however, the depth of cut limiters 324 may also have greater or lesser exposure than a leading cutting element 335. The depth of cut limiters 324 may be formed from polycrystalline diamond, tungsten carbide, titanium carbide, cubic boron nitride, other superhard materials, or some combination of the foregoing. In some embodiments, the depth of cut limiters 324 may have higher wear resistance properties than the materials of the body 337 (e.g., steel). The depth of cut limiters 324 may include diamond enhanced inserts, diamond impregnated inserts, tungsten carbide inserts, semi-round top inserts, inserts with cutting capacity, other inserts or elements, or combinations of the foregoing. For instance, the depth of cut limiters 324 may include diamond enhanced inserts with a rounded outer surface, while the cutting elements 335 may include shear cutting elements, non-planar cutting elements (e.g., conical, dome, semi-round top, bullet, ridge, etc.), or cutters oriented for providing primarily wear reinforcement or protection capabilities.

The depth of cut limiters 324 may directly trail one or more cutting elements 335 of the leading row 348-1, although in other embodiments the depth of cut limiters 324 may be axially offset from the cutting elements 335 of the leading row 348-1. In some embodiments, the length of the trailing row 348-2 that includes cutting elements 335 and depth of cut limiters 324 may be about the same and the length of the leading row 348-1 that includes cutting elements 335. In some embodiments, the leading row 348-1 may include depth of cut limiters 324, or depth of cut limiters 324 may be located outside the rows 348. Additionally, while FIGS. 3-1 to 3-3 illustrate two rows 348 in the underreaming portion 347, in other embodiments there may be a single row or more than two rows. Additionally, in some embodiments, one or more mud flutes/channels or other features may be formed in the formation facing surface 341 (e.g., between rows 348).

As further shown in FIGS. 3-1 to 3-3, a cutter block 320 may include different portions, including one or more of a backreaming portion 350, or a gauge portion 351. The gauge portion 351 may be configured to define the size of the wellbore as enlarged by the cutter blocks 320 (or to stabilize the downhole tool in the wellbore), and the underreaming portion 347 and/or backreaming portion 350 may taper from the gauge portion 351 to a reduced size or radial position.

The underreaming portion 347 may include the cutting elements 335 arranged in the rows 348 as discussed herein, or in some other arrangement. In some embodiments, the backreaming portion 350 may also include cutting elements 335 arranged in one or more rows 352 (a leading row 352-1 and trailing row 352-2 are shown here). As discussed herein with respect to the rows 348, the rows 352 may have the same or different lengths or may have the same or different numbers of cutting elements 335. In the illustrated embodiment, the leading row 352-1 is shown as having three cutting elements and having a greater length than the trailing row 352-2. Additionally, the rows 352 may have cutting elements 335, depth of cut limiters 324, or both. Further, the rows 352 may be arranged, designed, or otherwise formed to include cutting elements 335 or depth of cut limiters 324 immediately behind the cutting elements 335 (or other elements) of the leading row 352-1, or in an offset position as shown in FIG. 3-2. The rows 352 may also be generally parallel to each other or to the longitudinal axis 338 as described with respect to rows 348. In some embodiments, one row 352 (e.g., trailing row 352-2) may be parallel to the longitudinal axis 338 while another row 352 (e.g., leading row 352-1) may be angled, curved, or otherwise aligned relative to the longitudinal axis 338. While two rows 352 are shown in FIGS. 3-1 to 3-3, in other embodiments there may be a single row 352 or more than two rows 352. In the same or other embodiments, mud flutes or channels may be formed in the backreaming portion 350, and optionally between adjacent rows 352.

In some embodiments, a gauge portion 351 of the cutter block 320 may be formed adjacent at least one of the underreaming portion 347 and the backreaming portion 350. For instance, the gauge portion 351 may be located between the underreaming portion 347 and the backreaming portion 350. The gauge portion 351 may include a gauge pad or stabilizer pad 322 on the formation facing surface 341. The stabilizer pad 322 optionally includes one or more gauge protection elements 353. The gauge protection elements 353 may be arranged, designed, or otherwise configured to restrict or even prevent wear of the body 337 on the stabilizer pad 322. For instance, as the cutter block 320 is used to cut or degrade formation in a wellbore, the formation may contact the gauge protection elements 353. The gauge protection elements 353 may be formed from polycrystalline diamond, tungsten carbide, titanium carbide, cubic boron nitride, other superhard materials, or some combination of the foregoing. In some embodiments, the gauge protection elements 353 have higher wear resistance properties than the materials of the body 337 (e.g., steel). The gauge protection elements 353 may include diamond enhanced inserts, diamond impregnated inserts, tungsten carbide inserts, semi-round top inserts, inserts with cutting capacity, other inserts or elements, or combinations of the foregoing. For instance, the gauge protection elements 353 may include tungsten carbide inserts.

The gauge protection elements 353 may be arranged in any suitable arrangement or pattern. In FIG. 3-3, for instance, the gauge protection elements 353 are arranged in three rows that extend axially along the stabilizer pad 322. The rows are optionally offset or staggered as shown in FIG. 3-3, and rows may have the same or different lengths, the same or different numbers of gauge protection elements, equal or unequal spacing between gauge protection elements 353, or combinations of the foregoing. In some embodiments, the gauge protection elements 353 may be replaced with other wear-resistant elements (e.g., hardfacing), aligned in other patterns, or have any other suitable feature.

The stabilizer pad 322 may have a uniform length across the width 352 of the formation facing surface 341, or the length may vary. In particular, a row of gauge protection elements 353 extends farther adjacent the trailing side surface 343 than adjacent the leading side surface 342. As such, the length of the stabilizer pad 322 may be larger adjacent the trailing side surface 343 than adjacent the leading side surface 342. In other embodiments, the stabilizer pad 322 may have a greater length adjacent the leading side surface 342 or at a position between the leading and trailing side surfaces 342, 343. Further, the stabilizer pad 322 may be symmetric or asymmetric along one, two, or more axes.

As shown in FIG. 3-2, a cutter block 320 may have a block height 354, which in use may be a radial height or distance. One or more splines 345 or other structures used to guide the cutter block 320 during expansion and retraction may be located in a guiding portion of the block, which is shown as having a guide height 355. In at least some embodiments, a ratio between the guide height 355 and the block height 354 may be between 20% and 80%. For instance, the ratio may be within a range having a lower limit, an upper limit, or both lower and upper limits including any of 20%, 30%, 40%, 45%, 50%, 55%, 60%, 70%, 80%, or values therebetween. In some example embodiments, the ratio between the guide height 355 and the block height 354 may be between 30% and 70%, between 40% and 55%, or between 45% and 50%. In other embodiments, the ratio may be less than 20% or greater than 80%.

As also described herein, cutting elements 335 or other cutting structures may be located on an underreaming portion 347, backreaming portion 350, gauge portion 351, or other portion of the cutter block 350. The cutting elements 335 or other structures may extend axially along a full or partial length of the cutter block 320, as well as radially a cutting structure height 356. In at least some embodiments, a ratio between the cutting structure height 356 and the block height 354 may be between 30% and 90%. For instance, the ratio may be within a range having a lower limit, an upper limit, or both lower and upper limits including any of 30%, 40%, 50%, 55%, 60%, 65%, 70%, 80%, 90%, or values therebetween. In some example embodiments, the ratio between the cutting structure height 356 and the block height 354 may be between 40% and 80%, between 50% and 65%, or between 56% and 61%. In other embodiments, the ratio may be less than 30% or greater than 90%.

Optionally, there may be an overlap between the cutting structure height 356 and the guide height 355. In at least some embodiments, a ratio between a height 357 of the overlap and the block height 354 may be between 0% and 70%. For instance, the ratio may be within a range having a lower limit, an upper limit, or both lower and upper limits including any of 0%, 5%, 10%, 15%, 20%, 30%, 40%, 50%, 60%, 70%, or values therebetween. In some example embodiments, the ratio between the height 357 of the overlap and the block height 354 may be between 0% and 30%, between 0% and 15%, or between 4% and 9%. In other embodiments, the ratio may be greater than 70%

The foregoing ratios are illustrative, and other ratios may be defined. For instance, a ratio may be defined between the height of a non-guide portion of the block between the guide portion and the gauge of the cutter block 320. In FIG. 3-2, the height of the non-guide portion may be defined as the cutting structure height 356 less the height 357 of the overlap, or as the block height 354 less the guide height 355, although it may be otherwise defined in other embodiments. Such a ratio may be between 20% and 80% in some embodiments. For instance, the ratio may be within a range having a lower limit, an upper limit, or both lower and upper limits including any of 20%, 30%, 40%, 45%, 50%, 55%, 60%, 70%, 80%, or values therebetween. In some example embodiments, the ratio between the non-guide height and the block height 354 may be between 30% and 70%, between 45% and 60%, or between 50% and 55%. In other embodiments, the ratio may be less than 20% or greater than 80%.

Ratios may also be defined between heights other than the block height 354. Example ratios may include, for instance, a ratio between the guide height 355 and the height of the non-guide portion, a ratio between the guide height 355 and the cutting structure height 356, a ratio between the height 357 of the overlap and the guide height 355, a ratio between the height 357 of the overlap and the cutting structure height 356, or a ratio between the height 357 of the overlap and the non-guide height.

By way of example, the ratio of the guide height 355 to the non-guide height may be between 50% and 150%, between 70% and 120%, between 85% and 100%, or between 89% and 94%. In other embodiments, the ratio may be less than 50% or greater than 150%.

Similarly, the ratio of the guide height 355 to the cutting structure height 356 may be between 40% and 140%, between 60% and 110%, between 75% and 90%, or between 79% and 84%. In other embodiments, such a ratio may be less than 40% or greater than 140%. An example ratio between the non-guide height and the cutting structure height may be between 50% and 150%, between 70% and 120%, between 85% and 100%, or between 86% and 91%. In other embodiments, the ratio may be less than 50% or greater than 150%.

In still other embodiments, the ratio between the height 357 of the overlap to the guide height 355 may be between 0% and 90%, between 0% and 50%, between 5% and 25%, or between 12% and 17%. In other embodiments, the ratio may be greater than 90%. A ratio between the height 357 of the overlap to the cutting structure height 356 may be between 0% and 85%, between 0% and 45%, between 5% and 20%, or between 9% and 14%. In other embodiments, the ratio may be greater than 85%. Similarly, a ratio between the height 357 of the overlap to the non-guide height may be between 0% and 85%, between 0% and 45%, between 5% and 20%, or between 10% and 15%. In other embodiments, the ratio may be greater than 85%.

Figure 4:
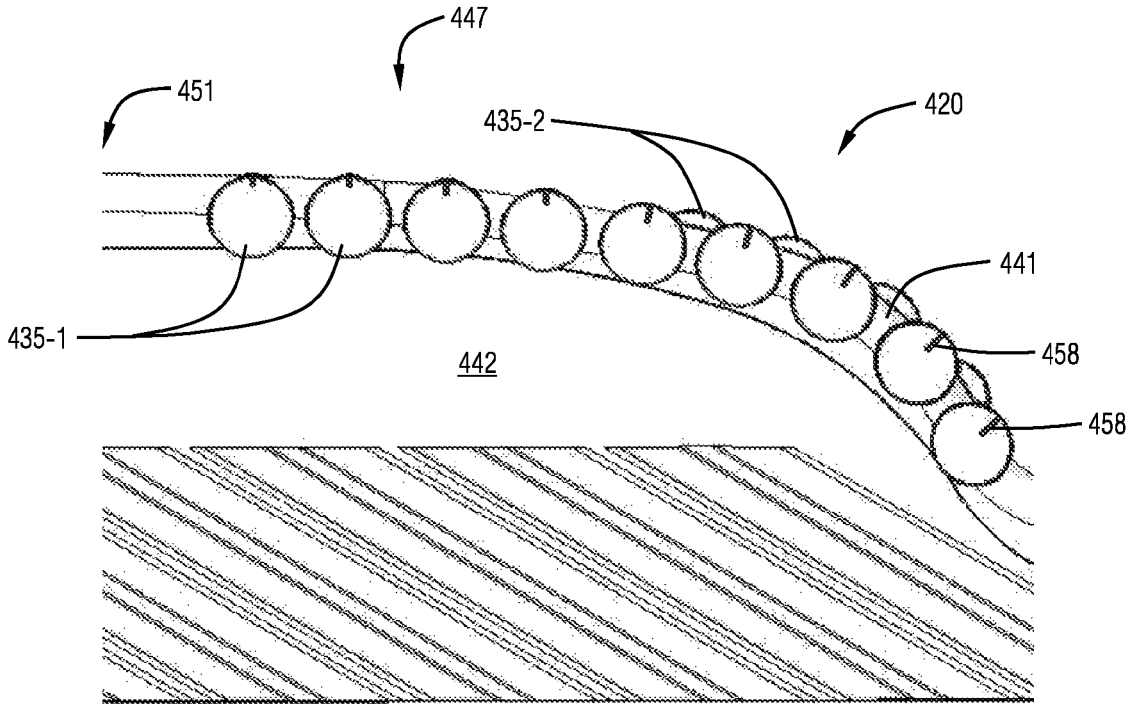
FIG. 4 is a side view of another cutter block, in accordance with embodiments disclosed herein.
Figure 5:
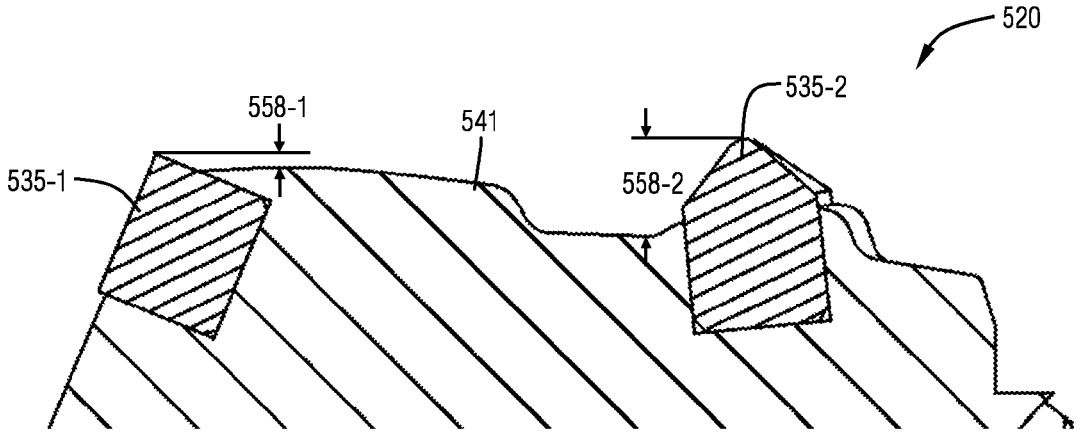
FIG. 5 is a cross-sectional side view of a portion of a cutter block having leading and trailing cutting elements, in accordance with embodiments disclosed herein.

Cutter blocks, arms, or other elements of a tool may be arranged, designed, or otherwise configured in any number of manners. For instance, the types of cutting elements, arrangements of cutting elements, materials for cutting elements, and the like may be changed from one design to another, varied within a single design or tool, or otherwise varied. FIGS. 4 and 5, for instance, illustrate some example arrangements of cutting elements that are optionally employed in some embodiments of the present disclosure.

In FIG. 4, a cutting tool (shown as cutter block 420) may include multiple cutting elements 435 arranged in any suitable manner. In this particular embodiment, for instance, leading cutting elements 435-1 and trailing cutting elements 435-2 are arranged to extend axially along a length of a portion (e.g., an underreaming or backreaming portion) of the cutter block 420. In at least some embodiments, the cutting elements 435 may have a non-zero exposure. Exposure refers the distance from the tip of the cutting element 435 and the corresponding surface of the block, and may generally define the depth of cut for a corresponding cutting element 435. In some embodiments, the surface of the cutter block 420 may be the formation facing surface 441, although other portions of the cutter block 420 may define the exposure depending on the location of the cutting element 435. A positive exposure refers to cutting elements 435 above the corresponding cutter block surface and a negative exposure refers to cutting elements 435 recessed within the corresponding cutter block surface.

Each cutting element 435 may have the same exposure or each cutting element 435 may have no exposure. In other embodiments, the exposure may be varied such that one or more cutting elements 435 have a different exposure from one or more other cutting elements 435. In FIG. 4, for instance, a side view of the cutter block 420 shows leading cutting elements 435-1 on the leading side surface 442, and trailing cutting elements 435-2 on the formation facing surface 441. In at least some embodiments, the exposure 458 of one or more of the leading cutting elements 435 is shown by the line extending inwardly from each cutting tip of the cutting elements 435-1. The exposure 458 may be variable. In the illustrated embodiment, for instance, the exposure 458 of a leading cutting element 435-1 may be different from the exposure 458 of an adjacent leading cutting element 435-1 or different from the exposure 458 of each other leading cutting element 435-1. In some embodiments, each leading cutting element 435-1 may have a different exposure 458.

Optionally, the exposure 458 of the leading cutting elements 435-1 may gradually change. In FIG. 4, for instance, the leading cutting elements 435-1 are shown as being located on a reaming portion 447 that increases in radial height toward a gauge portion 451. The leading cutting elements 435-1 nearest a stabilizing or gauge portion 451 may have a greater radial position and less exposure 458 than leading cutting elements 435-1 farther from the gauge portion 451, which may have a lesser radial position. For instance, the exposure 458 of the leading cutting element 435-1 nearest the gauge portion 451 may be less than the exposure 458 of any other leading cutting element 435-1, the exposure 458 of the leading cutting element 435-1 farthest from the gauge portion 451 may be greater than the exposure 458 of any other leading cutting element 435-1, or combinations of the foregoing may apply.

Optionally, the exposure 458 may gradually increase when moving axially away from the gauge portion 451. In such an embodiment, the exposure 458 of a leading cutting element 435-1 may be greater than the exposure 458 of an adjacent leading cutting element 435-1 that is axially nearer the gauge portion 451. In other embodiments, the exposure 458 may gradually or otherwise decrease when moving axially away from the gauge portion 451. In still other embodiments, adjacent leading cutting elements 435-1 may have the same exposure. Optionally, the leading cutting elements 435-1 with a higher depth of cut (and higher volume of material removed) may have higher exposure 458, and leading cutting elements 435-1 with lower depth of cut and lower removal volume may have a lower depth of cut. For instance, leading cutting elements 435-1 nearer the gauge portion 451 and a greater radial position may have a lower depth of cut and a lower removal volume, while leading cutting elements 435-1 farther from the gauge portion 451 and a lesser radial position may have a greater depth of cut and a greater removal volume. In at least some embodiments, leading cutting elements 435-1 near the gauge portion or at greater radial positions may be protected against increased impact damage from high lateral vibrations by reducing the exposure 458 of such leading cutting elements 435-1. This may allow vibrations to be distributed across the body of the cutter block 420. In some embodiments, a variable exposure may further reduce stick-slip tendencies, whirl tendencies, or both, that could result from a side cutting element taking a sudden high depth of cut due to lateral vibrations, which could result in an eccentric pivot point.

The amount each leading cutting element 435-1 is exposed may be different in various embodiments, and may be based on a number of factors, including the type or shape of the leading cutting elements 435-1, the type and shape of the cutter block 420, the type of formation or other material to be cut by the cutter block 420, the amount of vibration anticipated in a downhole operation, the rate of penetration that is desired, other factors, or combinations of the foregoing. For instance, in some embodiments, the exposure 458 of each leading cutting element 435-1 (and potentially between different leading cutting elements 435-1 in embodiments with a variable exposure 458) may be within a range having lower limits, upper limits, or both lower and upper limits including any of 0.000 in. (0.0 mm), 0.005 in. (0.1 mm), 0.01 in. (0.3 mm), 0.025 in. (0.6 mm), 0.05 in. (1.3 mm), 0.075 in. (1.9 mm), 0.1 in. (2.5 mm), 0.125 in. (3.2 mm), 0.15 in. (3.8 mm), 0.175 in. (4.4 mm), 0.2 in. (5.1 mm), 0.225 in. (5.7 mm), 0.25 in. (6.4 mm), 0.275 in. (7.0 mm), 0.3 in. (7.6 mm), 0.4 in. (10.2 mm), 0.5 in. (12.7 mm), or values therebetween. For instance, the exposure 458 of the leading cutting elements 435-1 of the reaming portion 447 may be between 0.000 in. (0.0 mm) and 0.4 in. (10.2 mm), between 0.005 in. (0.1 mm) and 0.25 in. (6.4 mm), or between 0.005 in. (0.1 mm) and 0.2 in. (5.1 mm). In other embodiments, the exposure 458 may be negative or may be greater than 0.5 in. (12.7 mm).

Varying the exposure 458 of leading cutting elements 435-1 may be used where the reaming portion 447 is an underreaming portion or a backreaming portion. A variable exposure 458 may therefore be present on an underreaming portion, on a backreaming portion, or on both an underreaming portion and a backreaming portion. Additionally, the trailing cutting elements 435-2 may have a constant exposure 458 or a variable exposure 458 as discussed herein. Such may be the case whether the trailing cutting elements 435-2 are in a back-up position directly behind a leading cutting element 435-1, or in another trailing position (e.g., when axially offset from leading cutting elements 435-1, on a second blade on the cutter block 420, etc.).

FIG. 5 is a cross-sectional view of a portion of an example cutter block 520 that has a leading cutting element 535-1 and a trailing cutting element 535-2. As shown, the leading cutting element 535-1 may be a shear cutting element having a planar face, while the trailing cutting element 535-2 may be a conical or other non-planar cutting element. In other embodiments, both the leading and trailing cutting elements 535 may be shear cutting elements, or both may be non-planar cutting elements.

The trailing cutting element 535-2 may have the same exposure as the corresponding leading cutting element 535-1. In other embodiments, however, the leading and trailing cutting elements 535 may have different exposures relative to the formation facing surface 541. For instance, in FIG. 5, the trailing cutting element 535-2 is shown as having an exposure 558-2 that is greater than the exposure 558-1 of the leading cutting element 535-1. In other embodiments, the exposure 558-1 may be greater than the exposure 558-2. In some embodiments, the leading cutting element 535-1, the trailing cutting element 535-2, or both may have a negative exposure or no exposure relative to an adjacent portion of the formation facing surface 541.

The cutter block 520 may have multiple leading cutting elements 535-1, multiple trailing cutting elements 535-2, or combinations of the foregoing. The leading cutting elements 535-1, trailing cutting elements 535-2, or both, may have a variable exposure as described herein. In some embodiments, for instance, the leading cutting elements 535-1 and the trailing cutting elements 535-2 may have a variable exposure. In other embodiments, the leading cutting elements 535-1 may have a variable exposure while the trailing cutting elements 535-2 each have the same exposure (i.e., a fixed or constant exposure). In still another embodiment, each of the leading cutting elements 535-1 may have the same exposure while the trailing cutting elements 535-2 have a variable exposure. In still other embodiments, one or more leading cutting elements 535-1 may have a different exposure than other leading cutting elements 535-1 having the same exposure as each other. Similarly, one or more trailing cutting elements 535-2 may a different exposure than other trailing cutting elements 535-2 having the same exposure as each other.

Figures 3, 6:
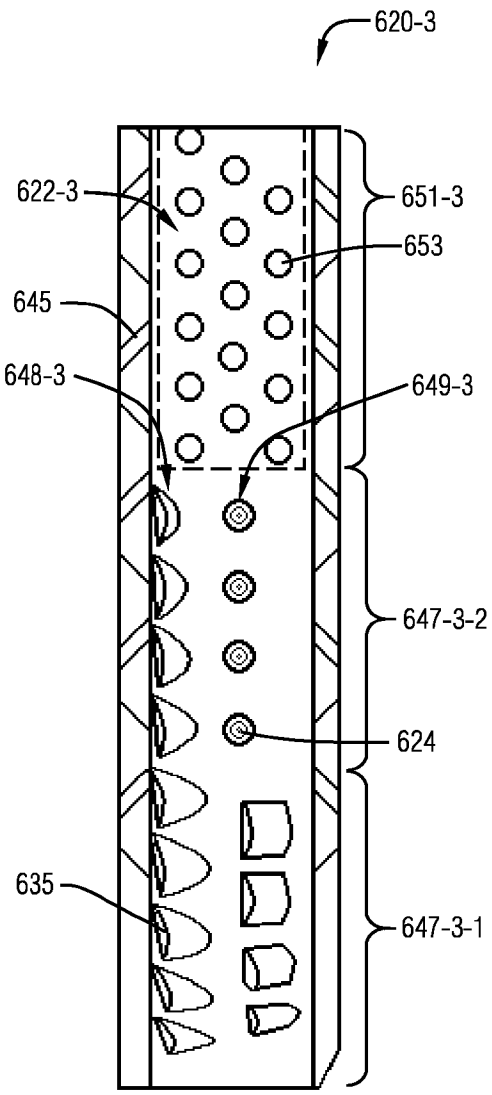
Figures 2, 6:
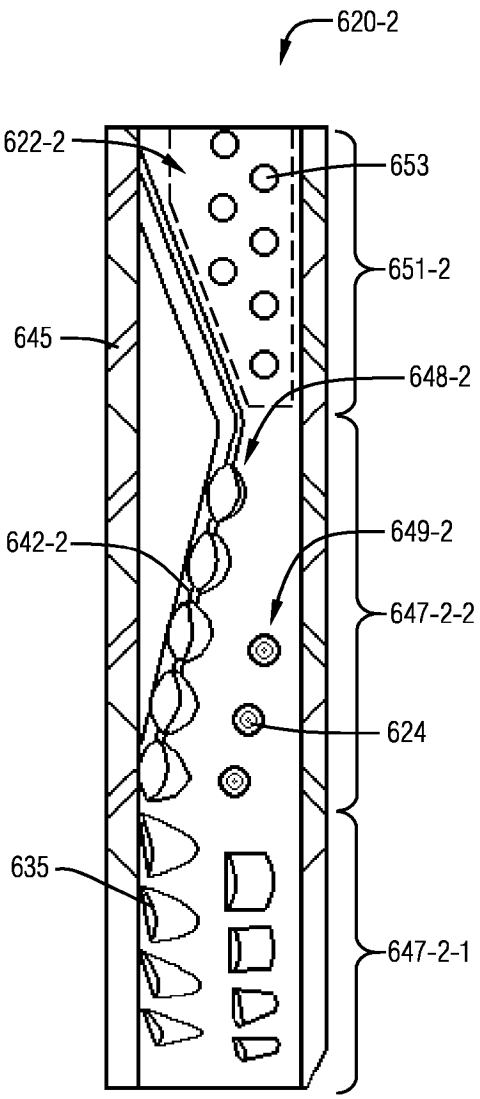
Figures 1, 6:
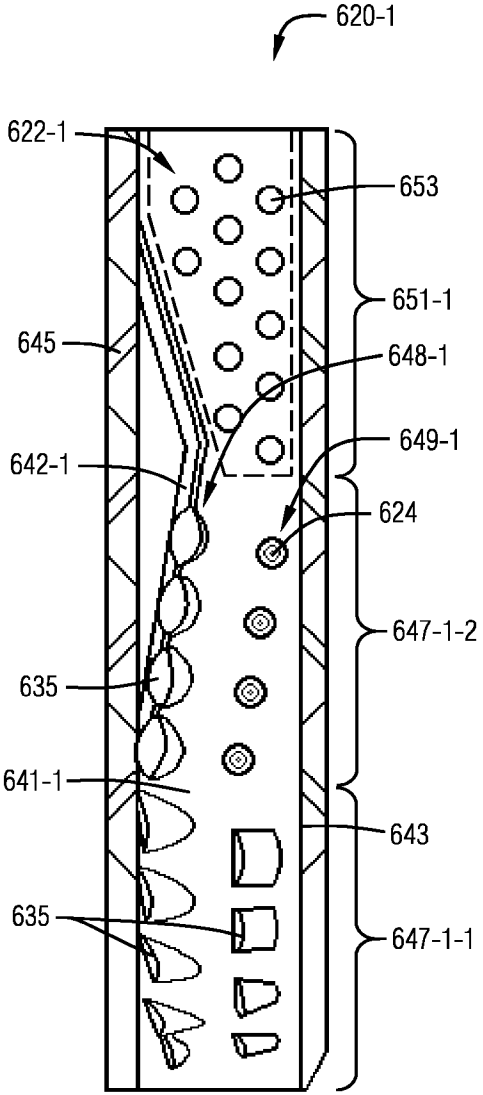

Turning now to FIGS. 6-1 to 6-3, top views of various example cutter blocks 620-1, 620-2, 620-3 (collectively cutter blocks 620) are shown in additional detail. In some embodiments, a downhole tool (e.g., underreamer 210 of FIGS. 2-1 and 2-2) may use multiple arms, blades, or other cutter blocks. Each cutter block may be the same. As such, such a downhole tool may include two, three, four, or more of cutter block 620-1, of cutter block 620-2, or of cutter block 620-3. In other embodiments, however, one or more of the cutter blocks of the downhole tool may be different. In such an embodiment, one or more of the cutter blocks may have different features such that features vary from one block to the next. For instance, the cutting elements may change (e.g., number, type, exposure, or position of cutting elements), the shape of cutter block features may change (e.g., shape of underreaming, backreaming, or gauge portions), the number of blades on a cutter block may change, or other features may vary between cutter blocks. In some embodiments, each cutter block may be different. For instance, the cutter blocks 620 of FIGS. 6-1 to 6-3 may each be used with the same downhole tool, and optionally at the same axial position and different circumferential position. In some embodiments, more than one of any of the cutter blocks 620 may be used in a downhole tool.

FIGS. 6-1 to 6-3 illustrate some differences in features of cutter blocks 620, whether such cutter blocks 620 are used in a same tool, or in different tools. For instance, the cutter block 620-1 of FIG. 6-1 includes a first reaming portions 647-1-1 and a gauge portion 651-1. In this embodiment, a second reaming portion 647-1-2 is also included between the first reaming portion 647-1-1 and the gauge portion 651-1. As shown the first and second reaming portions 647-1 may include one or more cutting elements 635. In the first reaming portion 647-1-1 (which is optionally has a reduced radius relative to the second reaming portion 647-1-2), cutting elements 635 may be arranged in one or more rows. The rows may be arranged as discussed herein, and may thus be parallel or non-parallel, may include leading and trailing rows, may include the same or different types of cutting elements, may be parallel or non-parallel to an axis of the cutter block 620-1, have other features, or have any combination of the foregoing. In this particular embodiment, for instance, the first reaming portion 647-1-1 of the cutter block 620-1 includes two substantially parallel rows of cutting elements 635. The cutting elements 635 in the trailing row are shown in offset axial positions; however, in other embodiments the cutting elements 635 of the trailing row may axially aligned with cutting elements 635 of the leading row, or otherwise operate as back-up cutting elements.

The second reaming portion 647-1-2 may also include one or more cutting elements 635 optionally arranged in one or more rows. The rows may be arranged as discussed herein, and may thus be parallel or non-parallel, may include leading and trailing rows, may include the same or different types of cutting elements, may be parallel or non-parallel to an axis of the cutter block 620-1, have other features, or have any combination of the foregoing. In this particular embodiment, for instance, the second reaming portion 647-1-2 of the cutter block 620-1 includes two substantially parallel rows. A first row 648-1 may include, for instance, shear cutting elements 635, non-planar cutting elements, or the like. A second row 649-1 may include depth of cut limiters 624. In other embodiments, the second row 649-1 may include shear cutting elements, non-planar cutting elements, or the like. The depth of cut limiters 624 of the second row 649-1 are shown in back-up, trailing positions and axially aligned with the cutting elements 635 of the first row 648-1; however, in other embodiments, the depth of cut limiters 624 or other elements of the second row 649-1 may trail the cutting elements 635 of the first row 648-1 while in offset axial positions.

As also shown in FIG. 6-1, the leading or first row 648-1 of the second reaming portion 647-1-2 may be at an angle relative to the leading row of the first reaming portion 647-1-1. For instance, the angle of the first row 648-1 relative to the leading row of the first reaming portion 647-1-1 (or relative to the longitudinal axis of the cutter block 620-1) may be within a range having a lower limit, an upper limit, or both a lower and an upper limit including any of 0°, 2.5°, 5°, 7.5°, 10°, 12.5°, 15°, 17.5°, 20°, 25°, 30°, 45°, 60°, or values therebetween. By way of example, the angle may be between 0° and 20°, between 5° and 15°, or between 7.5° and 12.5°. In other embodiments, the angle may be greater than 60°.

Optionally, a formation facing surface 641-1, a leading side surface 642-1, or both, may also be angled at a position adjacent the first row 648-1. In the illustrated embodiment, the first row 658-1 and the corresponding portions of the formation facing surface 641-1 and the leading side surface 642-1 may be angled inwardly toward the gauge portion 651-1. In such an embodiment, the width of the formation facing surface 641-1 (e.g., the distance between the leading side surface 642-1 and a trailing side surface 643) may be less nearer the gauge portion 651-1 than nearer the first reaming portion 647-1. Similarly, the distance between the trailing side surface 643 and a cutting element 635 may be less nearer the gauge portion 651-1 than nearer the first reaming portion 647-1-1.

As also shown in FIG. 6-1, the trailing, back-up, or second row 649-1 of the second reaming portion 647-1-2 may also be at an angle relative to the trailing row of the first reaming portion 647-1-1. For instance, the angle between the second row 649-1 and the trailing row of the first reaming portion 647-1-1 may be within a range having a lower limit, an upper limit, or both a lower and an upper limit including any of 0°, 2.5°, 5°, 7.5°, 10°, 12.5°, 15°, 17.5°, 20°, 25°, 30°, 45°, 60°, or values therebetween. By way of example, the angle may be between 0° and 20°, between 5° and 15°, or between 7.5° and 12.5°. In other embodiments, the angle may be greater than 60°. In some embodiments, the first and second rows 642-1, 649-1 may be about parallel.

In some embodiments, the gauge portion 651-1 may include a stabilizer pad 622-1 (generally shown by the dashed lines), gauge protection elements 653, other components, or any combination of the foregoing. In this particular embodiment, gauge protection elements 653 may be arranged in three parallel rows, with the gauge protection elements 653 in each row being axially offset relative to gauge protection elements 653 in an adjacent row. Optionally, one or more rows may be of different lengths. For instance, the leading side surface 642-1 adjacent the stabilizer pad 622-1 may angle inwardly toward the second reaming portion 647-1-2, and the width of the formation facing surface 641-1 may decrease when getting nearer the second reaming portion 647-1-2. As a result, the stabilizer pad 622-1 may not have a constant width and a row of gauge protection elements 653 nearer the trailing side surface 643 may be longer or extend to a point nearer the second reaming portion 647-1-2 than a row of gauge protection elements 653 nearer the leading side surface 642-1. Of course, gauge protection elements 653 may be arranged in any suitable pattern, and may not be arranged in rows, but may instead be arranged in helical, angled, circular, or other patterns, or in a random or pseudo-random manner.

The stabilizer pad 622-1 may have any suitable shape, or may be omitted entirely, depending on the desired performance characteristics of the cutter block 620-1. For instance, FIG. 6-1 illustrates the stabilizer pad 622-1 as having a pentagonal shape with three right angles and two obtuse angles. A similar shape could be formed by removing a corner of a rectangle. In particular, the angle of the removed portion may generally be aligned with the angle of the leading side surface 642-1 in the gauge portion 651-1. For instance, the angle between a longitudinal axis of the cutter block 620-1 and the leading side surface 642-1 adjacent the stabilizer pad 622-1 may be within a range having a lower limit, an upper limit, or both a lower and an upper limit including any of 0°, 2.5°, 5°, 7.5°, 10°, 12.5°, 15°, 17.5°, 20°, 22.5°, 25°, 27.5°, 30°, 45°, 60°, 75°, or values therebetween. By way of example, the angle may be between 0° and 45°, between 10° and 30°, between 12.5° and 22.5°, or between 15° and 20°. In other embodiments, the angle may be greater than 75°. The angle may be different in magnitude, direction, or both from an angle of a first or second row 642-1, 649-1 in the second reaming portion 647-1-2, a row of cutting elements 635 in the first reaming portion 647-1-1, or both. In at least some embodiments, the angle may be the same as the angle of the first or second rows 642-1, 649-1, or the angle of one or more rows of cutting elements 635 in the first reaming portion 647-1-1.

Multiple cutter blocks 620-1 may be used in a downhole tool, a reaming tool, or another cutting tool. In other embodiments, different cutter blocks may be used, either with or without the cutter blocks 620-1. FIG. 6-2, for instance, illustrates another example cutter block 620-2 that differs from the cutter block 620-1 of FIG. 6-1, and which may be used in combination with, or without, the cutter block 620-1 of FIG. 6-1. As shown, the cutter block 620-2 may differ from the cutter block 620-1 in any number of manners, such as by the number of cutting elements 635 in a first underreaming portion 647-2-1, in a second underreaming portion 647-2-2, or both. Additional or other differences may be the position or arrangement of cutting elements 635 (e.g., radial position, rake angle, strike angle, etc.), the number or position/arrangement (or both) of depth of cut limiters 624, the number or position/arrangement of gauge protection elements 653, the size or configuration of the stabilizer pad 622-2, in other manners, or any combination of the foregoing. In still other embodiments, different types of cutting elements 635, depth of cut limiters 624, or the like may be used on one cutter block 620-2 as compared to another (e.g., cutter block 620-1).

The cutter block 620-2 may include some features similar to those described for cutter block 620-1 of FIG. 6-1. One example difference, however, may be the angle of a first row 648-2 of cutting elements 635, and the corresponding angle of the leading side surface 642-2 adjacent the first row 648-2. For instance, the angle of the first row 648-2 in the second underreaming portion 647-2-2, relative to the longitudinal axis of the cutter block 620-2 or to a leading row of cutting elements 635 in a first reaming portion 647-2-1, may be greater than the angle of the first row 648-1 of FIG. 6-1. For instance, the angle between the first row 648-2 and the leading row of the first reaming portion 647-2-1 (or the longitudinal axis of the cutter block 620-2) may be within a range having a lower limit, an upper limit, or both a lower and an upper limit including any of 0°, 2.5°, 5°, 7.5°, 10°, 12.5°, 15°, 17.5°, 20°, 25°, 30°, 45°, 60°, or values therebetween. By way of example, the angle may be between 0° and 30°, between 10° and 25°, or between 12.5° and 17.5°. In other embodiments, the angle may be greater than 60°. Optionally, the second row 649-2 of depth of cut limiters 624 may be at the same or different angle as the first row 648-2, as described in more detail relative to FIG. 6-1. In some embodiments, such as that shown in FIG. 6-2, the number of depth of cut limiters 624 in the second row 649-2 may be different from the number of cutting elements 635 in the first row 648-2 within the second reaming portion 647-2-2.

The stabilizer pad 622-2 may also be different from the stabilizer pad 622-1. For instance, the stabilizer pads 622-1, 622-2 are shown as having a similar pentagonal shape; however, the stabilizer pad 622-2 may be shorter, may have a smaller minimum width, and may have a different angle adjacent the leading side surface 642-2. For instance, in the illustrated embodiment, the angle between a longitudinal axis of the cutter block 620-2 and the leading side surface 642-2 adjacent the stabilizer pad 622-2 may be within a range having a lower limit, an upper limit, or both a lower and an upper limit including any of 0°, 2.5°, 5°, 7.5°, 10°, 12.5°, 15°, 17.5°, 20°, 22.5°, 25°, 27.5°, 30°, 45°, 60°, 75°, or values therebetween. By way of example, the angle may be between 5° and 50°, between 10° and 35°, between 15° and 25°, or between 17.5° and 22.5°. In other embodiments, the angle may be greater than 75°. As with the cutter block 620-1, the angle on the stabilizer pad 622-2 may be the same or different in terms of magnitude, direction, or both, when compared to the angle of a first or second row 648-2, 649-2 in the second reaming portion 647-2-2, a row of cutting elements 635 in the first reaming portion 647-2-1, or both.

The stabilizer pad 622-2 in the gauge portion 651-2 is further shown as having fewer gauge protection elements 653 when compared to the stabilizer pad 622-1. In particular, the gauge protection elements 653 are shown as being arranged in offset axial positions in two rows. Additionally, the rows may be shorter than the rows shown in FIG. 6-1. Of course, other arrangements may also be also be used, and gauge protection elements 653 may not be in rows, may be in longer rows, may have different sizes, may be otherwise configured or arranged, or combinations of the foregoing.

FIG. 6-3 illustrates another example cutter block 620-3 that differs from the cutter blocks 620-1, 620-2 of FIGS. 6-1 and 6-2, and which may be used in combination with, or without, the cutter blocks 620-1, 620-2. As shown, the cutter block 620-3 may differ from the cutter blocks 620-1, 620-2 in any number of manners, such as by the number of cutting elements 635 in a first underreaming portion 647-3-1, in a second underreaming portion 647-3-2, or both. Additional or other differences may be the position or arrangement of cutting elements 635 (e.g., radial position, rake angle, strike angle, etc.), the number or position/arrangement (or both) of depth of cut limiters 624, the number or position/arrangement of gauge protection elements 653, the size or configuration of a stabilizer pad 623-2 in a gauge portion 651-3, in other manners, or any combination of the foregoing. In still other embodiments, different types of cutting elements 635, depth of cut limiters 624, or the like may be used on one cutter block 620-3 as compared to another (e.g., cutter blocks 620-1, 620-2).

The cutter block 620-3 may include some features similar to those described for cutter blocks 620-1, 620-2. One example difference, however, may be the angle of a first row 648-3 of cutting elements 635, and the corresponding angle of the leading side surface 643-2 adjacent the first row 648-3. For instance, the angle of the first row 648-3 in a second underreaming portion 647-3-2, relative to the longitudinal axis of the cutter block 620-3 or to a leading row of cutting elements 635 in a first reaming portion 647-3-1, may be less than the angle of the first rows 648-1, 648-2 of FIGS. 6-1 and 6-2. For instance, the first row 648-3 may be about parallel to (and optionally collinear with) the leading row of the first reaming portion 647-3-1 (or the longitudinal axis of the cutter block 620-3). In other embodiments, the angle therebetween may be within a range having a lower limit, an upper limit, or both a lower and an upper limit including any of 0°, 2.5°, 5°, 7.5°, 10°, 12.5°, 15°, 17.5°, 20°, 25°, 30°, or values therebetween. By way of example, the angle may be between 0° and 20°, between 0° and 10°, or between 0° and 5°. In other embodiments, the angle may be greater than 30°. Optionally, the second row 649-3 of depth of cut limiters 624 may be at the same or different angle as the first row 648-3, as described in more detail relative to FIG. 6-1. In some embodiments, such as that shown in FIG. 6-3, the number of depth of cut limiters 624 in the second row 649-3 may be the same as the number of cutting elements 635 in the first row 648-3 and within the second reaming portion 647-3-2.

The stabilizer pad 622-3 may also be different from the stabilizer pads 622-1, 622-2. For instance, the stabilizer pad 622-3 is shown as having a rectangular shape, although it may have one or more angled surfaces or other features in other embodiments. The stabilizer pad 622-3 in the gauge portion 651-3 is further shown as having three axially offset rows of gauge protection elements 653, and may include more gauge protection elements 654 than the stabilizer pads 622-1, 622-2. In particular, the gauge protection elements 653 are shown as being arranged in offset axial positions in three rows extending substantially the full axial length of the stabilizer pad 622-3. Optionally, one or more rows may be longer than the rows shown in FIGS. 6-1 and 6-2, although one or more rows may be shorter in other embodiments. Of course, other arrangements may also be also be used, and gauge protection elements 653 may not be in rows, may have different sizes, may be otherwise configured or arranged, or combinations of the foregoing.

The cutter blocks 620 may have any number of similarities or differences. For instance, the length, width, height, profile, material, other characteristics, or combinations of the foregoing may be varied. Additionally, the cutter blocks 620 of FIGS. 6-1 to 6-3 are shown as having splines 645 (e.g., for use in expanding/retracting the cutter blocks 620). In some embodiments, one or more cutter blocks may have splines 645 at different angles, of different shapes, or having other features. Some cutter blocks may also not have grooves, rails, or other splines 645. Other cutter blocks according to the present disclosure may have splines on other surfaces (e.g., on a bottom surface or on uphole/downhole end surfaces). Still other embodiments may be coupled to lateral biasing members to assist in retracting and expanding the cutter blocks.

Additionally, while the cutter blocks 620 are shown as having similar rows of cutting elements 635 in corresponding first reaming portions 647-1-1, 647-2-1, 647-3-1, these rows could be varied in other embodiments. In particular, FIGS. 6-1 to 6-3 show such two rows of cutting elements 635 extending generally parallel to the longitudinal axis of the cutter block 620. The number of cutting elements 635 or position of such cutting elements 635 may vary from cutter block to cutter block as shown (e.g., to form a continuous cutting profile), or the number or position of cutting elements 635 may be the same from cutter block to cutter block. In other embodiments, the leading row, the trailing row, or both rows of cutting elements 635 in the first reaming portions 647-1-1, 647-2-1, 647-3-1 may be angled in other manners. Similarly, different types of cutting elements may be located in such rows, a single row may be used, or more than two rows may be used.

The term "cutting element" as used herein generically refers to any type of cutting element, unless otherwise specified. Cutting elements may have a variety of configurations, and in some embodiments may have a planar cutting face (e.g., similar to cutting elements 535-1 of FIG. 5). "Non-planar cutting elements" will refer to cutting elements having a non-planar cutting surface or end, such as a generally pointed cutting end ("pointed cutting element") or a generally conical cutting element having a crest or ridge cutting region ("ridge cutting element"), e.g., having a cutting end terminating in an apex, which may include cutting elements having a conical cutting end (shown by cutting element 535-2 of FIG. 5 or cutting element 735 of FIG. 7), a bullet cutting element (shown in FIG. 8), or a generally conical cutting element having a ridge (e.g., a crest or apex) extending across a full or partial diameter of the cutting element (shown in FIG. 10-1), for example.

Figure 7:
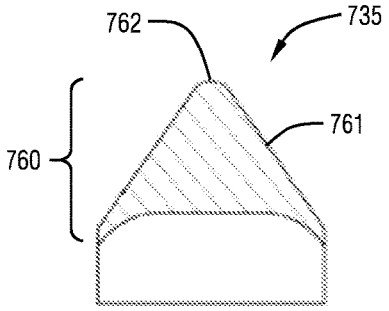
FIGS. 7 to 9 are side cross-sectional views of cutting elements, in accordance with embodiments disclosed herein.
Figure 8:
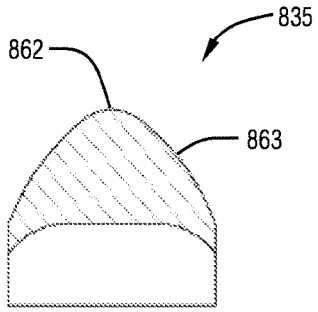
Figure 9:
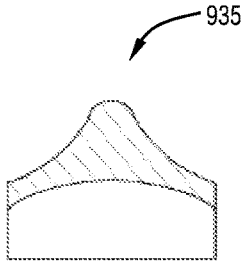

As used herein, the term "conical cutting elements" refers to cutting elements having a generally conical cutting end 760 (including either right cones or oblique cones), i.e., a conical side wall 761 that terminates in a rounded apex 762, as shown in the cutting element 735 of FIG. 7. Unlike geometric cones that terminate at a sharp point apex, the conical cutting elements of some embodiments of the present disclosure possess an apex 762 having curvature between the conical side wall 761 and the apex 762. Further, in one or more embodiments, a bullet cutting element 835 may be used. The term "bullet cutting element" refers to a cutting element having, instead of a generally conical side surface, a generally convex side surface 863 terminating at a rounded apex 862. In one or more embodiments, the apex 862 has a substantially smaller radius of curvature than the convex side surface 863. Both conical cutting elements and bullet cutting elements are "pointed cutting elements," having a pointed end that may be abrupt/sharp or rounded. It is also intended that the non-planar cutting elements of the present disclosure may also include other shapes, including, for example, a pointed cutting element may have a concave side surface terminating in a rounded or apex, as shown by the cutting element 935 of FIG. 9.

Figures 1, 10:
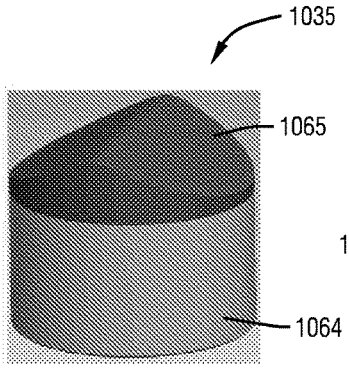
Figures 2, 10:
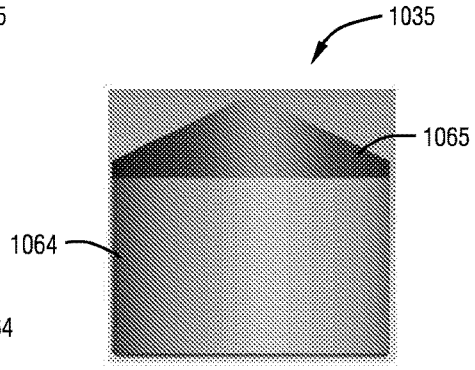
Figure 11:
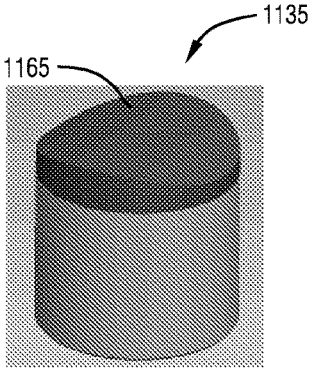
FIG. 11 is a perspective view of another ridge cutting element, in accordance with embodiments disclosed herein.

The term "ridge cutting element" refers to a cutting element that has a cutting crest (e.g., a ridge or apex) extending a height above a substrate (e.g., cylindrical substrate 1064 of FIG. 10-1), and at least one recessed region extending laterally away from the crest. An embodiment of a ridge cutting element 1035 is depicted in FIGS. 10-1 and 10-2, where the cutting element top surface 1065 has a parabolic cylinder shape and is coupled to the substrate 1064. Variations of the ridge cutting element may also be used, and for example, while the recessed region(s) may be shown as being substantially planar, the recessed region(s) may instead be convex or concave. While the crest is shown as extending substantially linearly along its length, it may also be convex or concave and may include one or more peaks and/or valleys, including one or more recessed or convex regions (e.g., depressions in the ridge), or may have a crest extending along less than a full width of the cutting element. In some embodiments, the ridge cutting element may have a top surface that has a reduced height between two cutting edge portions, thereby forming a substantially saddle shape or hyperbolic paraboloid (e.g., top surface 1165 of the cutting element 1135 of FIG. 11).

Figures 1, 12:
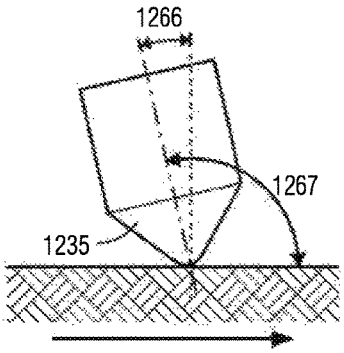
Figures 2, 12:
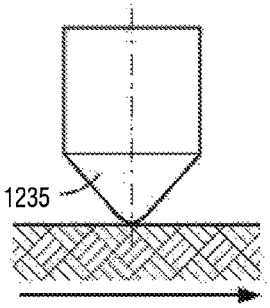
Figures 3, 12:
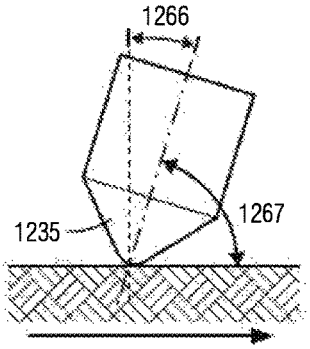

Orientations of planar cutting elements (or shear cutting elements) on an underreamer may be referenced using terms such as "side rake" and "back rake." While non-planar cutting elements may be described as having a back rake and side rake in a similar manner as planar cutting elements, non-planar cutting elements may not have a cutting face or may be oriented differently (e.g., out from a formation facing surface rather than toward a leading edge), and thus the orientation of non-planar cutting elements should be defined differently. When considering the orientation of non-planar cutting elements, in addition to the vertical or lateral orientation of the cutting element body, the non-planar geometry of the cutting end also affects how and the angle at which the non-planar cutting element strikes the formation. Specifically, in addition to the back rake affecting the aggressiveness of the interaction of the non-planar cutting element with the formation, the cutting end geometry (specifically, the apex angle and radius of curvature) may greatly affect the aggressiveness that a non-planar cutting element attacks the formation. In the context of a pointed cutting element, as shown in FIGS. 12-1 to 12-3 (collectively FIG. 12), back rake is defined as the angle 1266 formed between the axis of the pointed cutting element 1235 (specifically, the axis of the pointed cutting end) and a line that is normal to the formation or other material being cut. As shown in FIG. 12-2, with a pointed cutting element 1235 having zero back rake, the axis of the pointed cutting element 1235 is substantially perpendicular or normal to the formation material. As shown in FIG. 12-3, a pointed cutting element 1235 having negative back rake angle 1266 has an axis that engages the formation material at an angle 1267 that is less than 90° as measured from the formation material. Similarly, a pointed cutting element 1235 having a positive back rake angle 1266 as shown in FIG. 12-1 has an axis that engages the formation material at an angle 1267 that is greater than 90° when measured from the formation material. In some embodiments, the back rake angle 1266 of the pointed cutting elements may be zero, or in some embodiments may be negative. In some embodiments, the back rake angle of the pointed cutting elements 1235 may be between −20° and 20°, −10° and 10°, 0° and 10°, or −5° and 50°.

Figure 13:
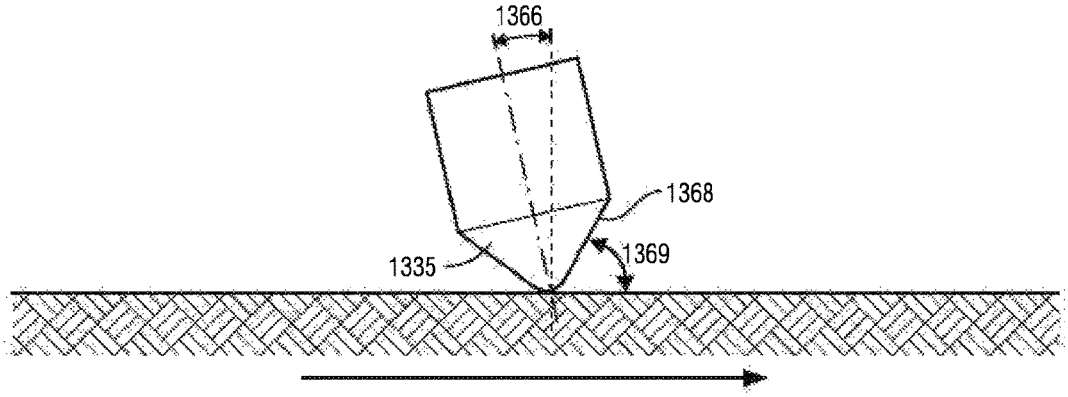
FIG. 13 is a side view of a cutting element having a strike angle, in accordance with embodiments disclosed herein.

In addition to the orientation of the axis with respect to the formation, the aggressiveness of pointed or other non-planar cutting elements may also be dependent on the apex angle or specifically, the angle between the formation and the leading portion of the non-planar cutting element. Because of the cutting end shape of the non-planar cutting elements, there does not exist a leading edge as found in a planar/shear cutting element; however, the leading line of a non-planar cutting surface may be determined to be the first points of the non-planar cutting element at each axial point along the non-planar cutting end surface as the attached body (e.g., body of an underreamer cutter block) rotates around a tool axis. Said in another way, a cross-section may be taken of a non-planar cutting element along a plane in the direction of the rotation of the tool, as shown in FIG. 13. The leading line 1368 of the pointed cutting element 1335 in such plane may be considered in relation to the formation. The strike angle of a pointed cutting element 1335 is defined to be the angle 1369 formed between the leading line 1368 of the pointed cutting element 1335 and the formation (or other workpiece) being cut. The angle 1369 may be affected by the geometry of the cutting element 1335, the back rake angle 1366, or other factors.

For polycrystalline diamond compact cutting elements (e.g., shear cutters), side rake is conventionally defined as the angle between the cutting face and the radial plane of the downhole tool (x-z plane). Non-planar cutting elements do not have a planar cutting face and thus the orientation of pointed cutting elements should be defined differently. In the context of a non-planar cutting element such as the pointed cutting elements 1435, shown in FIGS. 14-1 to 15-3, side rake is defined as the angle 1470 formed between the axis of the cutting element 1435 (specifically, the axis of the conical cutting end in the illustrated embodiment) and a line perpendicular to the tool or cutter block centerline. Side rake may be defined in other manners. For instance, side rake could be defined as an angle formed between the axis of the cutting element 1435 and a line perpendicular to the tangent of the profile of the cutter block at the location of the cutting element. In FIGS. 14-1 to 15-3, the z-axis may represent the line perpendicular to the tool centerline or the line perpendicular to the tangent of the cutter block profile.

Figures 1, 14:
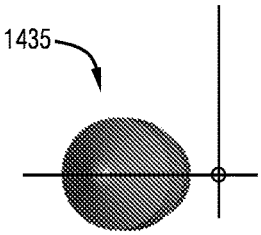
Figures 2, 14:
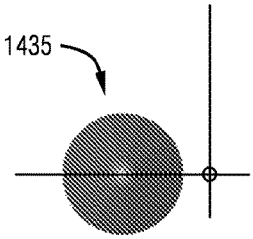
Figures 3, 14:
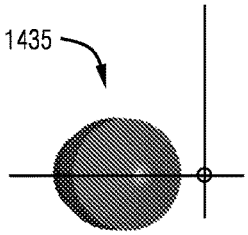
Figures 1, 15:
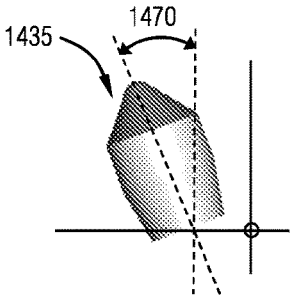
Figures 2, 15:
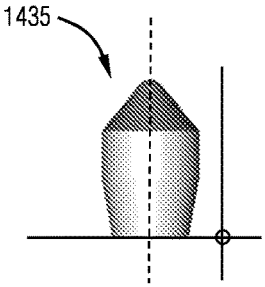
Figures 3, 15:
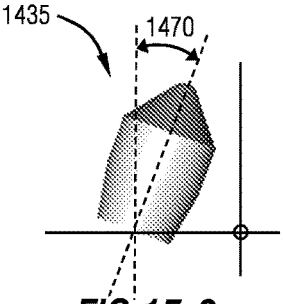

As shown in FIGS. 14-2 and 15-2, with a pointed cutting element 1435 having zero side rake, the axis of the pointed cutting element 1435 is substantially parallel to the z-axis. A pointed cutting element 1435 having negative side rake angle 1470, as shown in FIGS. 14-1 and 15-1 has an axis that is pointed away from the direction of the tool centerline. Conversely, a pointed cutting element 1435 having a positive side rake angle 1470 as shown in FIGS. 14-3 and 15-3 has an axis that points toward the direction of the tool centerline. The side rake of the pointed cutting elements 1435 may range between −30° and 30°, between −10° and 10°, or between −5° and 5° in some embodiments. Further, the side rake angle 1470 of non-planar cutting elements may be selected from these or other ranges in embodiments of the present disclosure. In some embodiments, leading cutting elements and trailing cutting elements may have the same or different side rake angles and/or back rake angles. For instance, a leading cutting element may have a positive back rake angle between 15° and 20° while a trailing or back-up cutting element may have a positive back rake angle of between 7° and 15°. In some embodiments, the side rake angle 1470 relative to the profile of a cutter block may be between −5° and 50°.

It should be understood that while elements are described herein in relation to depicted embodiments, each element may be combined with other elements of other embodiments. For example, any or each of the planar cutting elements 335 of FIGS. 3-1 to 3-3 may be replaced by non-planar cutting elements.

While embodiments of underreamers and cutter blocks have been primarily described with reference to wellbore enlargement operations, the devices described herein may be used in applications other than the drilling or enlargement of a wellbore. In other embodiments, underreamers and cutter blocks according to the present disclosure may be used outside a wellbore or other downhole environment used for the exploration or production of natural resources. For instance, tools and assemblies of the present disclosure may be used in a wellbore used for placement of utility lines, in a medical procedure (e.g., to clear blockages within an artery), in a manufacturing industry (e.g., to expand a diameter of a bore within a component), or in other industries (e.g., aquatic, automotive, etc.). Accordingly, the terms "wellbore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where a range of values includes various lower or upper limits, any two values may define the bounds of the range, or any single value may define an upper limit (e.g., up to 50%) or a lower limit (at least 50%).

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. It should be understood that "proximal," "distal," "uphole," and "downhole" are relative directions. As used herein, "proximal" and "uphole" should be understood to refer to a direction toward the surface, rig, operator, or the like. "Distal" or "downhole" should be understood to refer to a direction away from the surface, rig, operator, or the like. When the word "may" is used herein, such term should be interpreted as meaning that the identified feature, function, characteristic, or the like is present in some embodiments, but is not present in other embodiments.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A cutting apparatus, comprising:

a cutter block; and a plurality of cutting elements coupled to the cutter block, wherein each cutting element of the plurality of cutting elements is disposed on the cutter block with an independent distance of vertical exposure from a tip of the cutting element to a formation facing surface of the cutter block, wherein the independent distances of vertical exposure of the cutting elements gradually increases in an uphole axial direction along the cutter block from an underreaming base of the cutter block to a gauge of the cutter block, or the independent distances of vertical exposure of the cutting elements gradually increases in a downhole axial direction along the cutter block from the gauge of the cutter block to the underreaming base of the cutter block.

2. The apparatus of claim 1, wherein the independent distances of vertical exposure of the cutting elements gradually increase in the downhole axial direction along the cutter block from the gauge of the cutter block to the underreaming base of the cutter block.

3. The apparatus of claim 2, wherein a cutting element of the plurality of cutting elements that is farthest from the gauge of the cutter block at the underreaming base has a greater distance of vertical exposure than any of the other cutting elements of the plurality of cutting elements.

4. The apparatus of claim 2, wherein a cutting element of the plurality of cutting elements that is nearest to the gauge of the cutter block has a lesser distance of vertical exposure than any of the other cutting elements of the plurality of cutting elements.

5. The apparatus of claim 1, the distance of vertical exposure of the plurality of cutting elements varying between 0.000 inch (0.0 mm) and 0.4 inch (10.2 mm).

6. The apparatus of claim 5, the distance of vertical exposure of the plurality of cutting elements varying between 0.005 inch (0.1 mm) and 0.25 inch (6.4 mm).

7. The apparatus of claim 6, the distance of vertical exposure of the plurality of cutting elements varying between 0.005 inch (0.1 mm) and 0.2 inch (5.1 mm).

8. The apparatus of claim 1, the plurality of cutting elements being shear cutting elements.

9. The apparatus of claim 1, the plurality of cutting elements being non-planar cutting elements.

10. The apparatus of claim 1, the plurality of cutting elements being a first plurality of cutting elements, and the apparatus further comprising a second plurality of cutting elements having a fixed exposure relative to the formation facing surface.

11. The apparatus of claim 10, the first plurality of cutting elements being leading cutting elements and the second plurality of cutting elements being trailing cutting elements.

12. The apparatus of claim 10, the first plurality of cutting elements being positioned on an underreaming portion of the cutter block and the second plurality of cutting elements being positioned on a backreaming portion of the cutter block.

13. The apparatus of claim 1, wherein the independent distances of vertical exposure of the cutting elements gradually increase in the uphole axial direction along the cutter block from the underreaming base of the cutter block to the gauge of the cutter block.

* * * * *